US006761114B2

(12) United States Patent
Koneczny et al.

(10) Patent No.: US 6,761,114 B2
(45) Date of Patent: Jul. 13, 2004

(54) SELF-INKING STAMP

(75) Inventors: Harald Koneczny, Salzburg (AT); Peter Zindl, Obertraun (AT)

(73) Assignee: Trodat GmbH, Wels (AT)

( * ) Notice: Subject to any disclaimer, the term of this patent is extended or adjusted under 35 U.S.C. 154(b) by 27 days.

(21) Appl. No.: 10/275,223

(22) PCT Filed: Apr. 18, 2001

(86) PCT No.: PCT/AT01/00115

§ 371 (c)(1),
(2), (4) Date: Nov. 26, 2002

(87) PCT Pub. No.: WO01/83227

PCT Pub. Date: Nov. 8, 2001

(65) Prior Publication Data

US 2004/0007144 A1 Jan. 15, 2004

(30) Foreign Application Priority Data

May 4, 2000 (AT) ..... 784/2000

(51) Int. Cl.[7] ..... B41K 1/42; B41K 1/56; B41K 1/40

(52) U.S. Cl. ..... 101/333; 101/103; 101/104; 101/108; 101/405

(58) Field of Search ..... 101/103, 104, 101/108, 333, 405; B41K 1/56, 1/40

(56) References Cited

U.S. PATENT DOCUMENTS 4,289,070 A * 9/1981 MacGregor ..... 101/327
4,676,162 A * 6/1987 Phipps et al. ..... 101/405
4,852,489 A 8/1989 Wall et al. ..... 101/334
5,152,223 A * 10/1992 Mairon ..... 101/334
5,765,484 A * 6/1998 Lam ..... 101/327
5,855,170 A * 1/1999 Shih ..... 101/327
5,974,969 A * 11/1999 Okumura et al. ..... 101/327
6,058,840 A * 5/2000 Poplawski et al. ..... 101/405
6,189,450 B1 * 2/2001 Shih ..... 101/327

FOREIGN PATENT DOCUMENTS

EP 0459969 12/1991 ..... B41K/1/40

* cited by examiner

*Primary Examiner*—Andrew H. Hirshfeld
*Assistant Examiner*—Marissa Ferguson
(74) *Attorney, Agent, or Firm*—Karl Hormann

(57) ABSTRACT

A self-inking stamp with overhead inking, with a lower component for placement on the surface to be stamped, with a swivel mechanism for a print platen support arranged in the lower component for swiveling reciprocal movement of a print platen support between a stamp pad and a support frame, and with an actuator upper component mounted for slideable movement against the bias of a spring relative to the lower component, the upper component straddling the lower component and connected by its lateral parts to the lower component by a print platen support swivel axle guided in elongated openings of the lower component, whereby the actuator upper component is provided with a substantially U-shaped body portion and a hood part of transparent material pivotally connected therewith and covering an oblique text receiving plate at the upper transverse member of the body portion and the open fron section of the body portion, and whereby the lower component in a direction away from the stamp pad receptacle at its front section forms an opening in a downward direction, the opening being covered by a transparent wall member extending upwardly from the support frame which is connected with the lower component by a resilient snap connection.

2 Claims, 3 Drawing Sheets

SELF-INKING STAMP

BACKGROUND OF THE INVENTION

1. Field of the Invention

The invention relates to a self-inking stamp with overhead inking, with a lower component for placement on the surface to be stamped, with a swivel mechanism for a print platen support arranged in the lower component for reciprocal movement by simultaneous swivelling between a stamp pad and a support frame, and with an actuator upper component mounted for slideable movement against the bias of a spring relative to the lower component, the upper component straddling the lower component and connected by its lateral parts to the lower component by a print platen support swivel axle guided in elongated openings of the lower component.

2. The Prior Art

Such self-inking stamps are known, for instance, from EP 0,459,969 A1. In those stamps the actuator upper component is structured substantially like a hood which is provided with front and rear openings for allowing access to a stamp pad exchangeably insertable into a horizontal shaft of the lower component of the stamp.

OBJECT OF THE INVENTION

It is an object of the invention by a novel construction of the actuator upper component and of the lower component not only to simplify the insertion of the stamp pad, especially in case of an exchange, while preventing any possibility of soiling, but also to provide an overall improvement in the operation of the stamp.

SUMMARY OF THE INVENTION

In a stamp of the kind referred to above this is accomplished, in accordance with the invention, by the actuator upper component being provided with a substantially U-shaped body portion and a hood portion of transparent material pivotally connected therewith which covers an oblique text receiving surface at the upper transverse member of the body portion and the open front section of the body portion and by the lower component remote from its stamp pad receptacle being provided with a downwardly facing opening, the opening being covered by a transparent wall member which is extending upwardly from the support frame which may be connected to the lower component by a resilient spring connection.

This construction simplifies an exchange of stamp pads by horizontal insertion or removal into or from the receiving shaft of the lower component because this can be done simply by upwardly pivoting the transparent hood which covers the stamp pad at its front section and protects it against unintentional displacement. At the same time, the operation of the stamp is improved as a result of an enlarged handling surface at the upper component and of a substantially uninterrupted transparent front section of the stamp which simplifies the positioning of the stamp.

In accordance with a preferred embodiment of the invention the pivotal hood is pivotally connected to the upper component in the area of the rear section thereof and extends from its connection to front section of the upper component across the apex thereof.

The releasable snap connection of the support frame with the lower component simplifies mounting of the print platen support by inserting it into guide slots in the lower component, before the support frame is connected for the first time.

DESCRIPTION OF THE SEVERAL DRAWING'S

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DESCRIPTION OF THE PREFERRED EMBODIMENT

Figure 1:
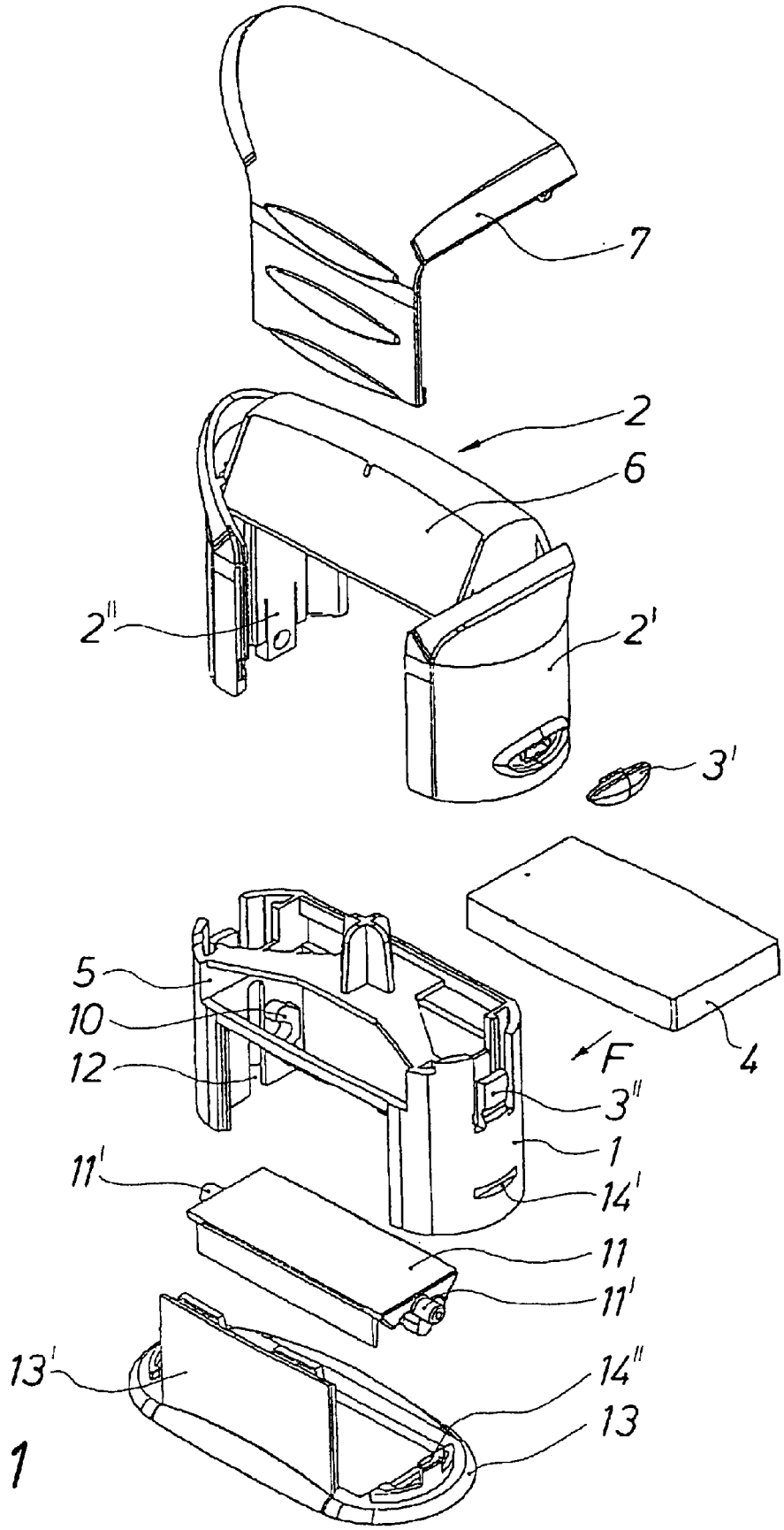
FIG. 1 is an exploded view of the complete stamp in accordance with the invention.

The self-inking stamp depicted in the exploded view of FIG. 1 is provided with a stamp lower component 1 and a substantially U-shaped actuator upper component 2 straddling the lower component 1 and connected therewith for movement relative to the lower component 1 against the bias of a spring.

The stamp lower component 1 receives a stamp pad 4, which is inserted in the direction of arrow F into a horizontal shaft 5 of the lower component.

Figure 3:
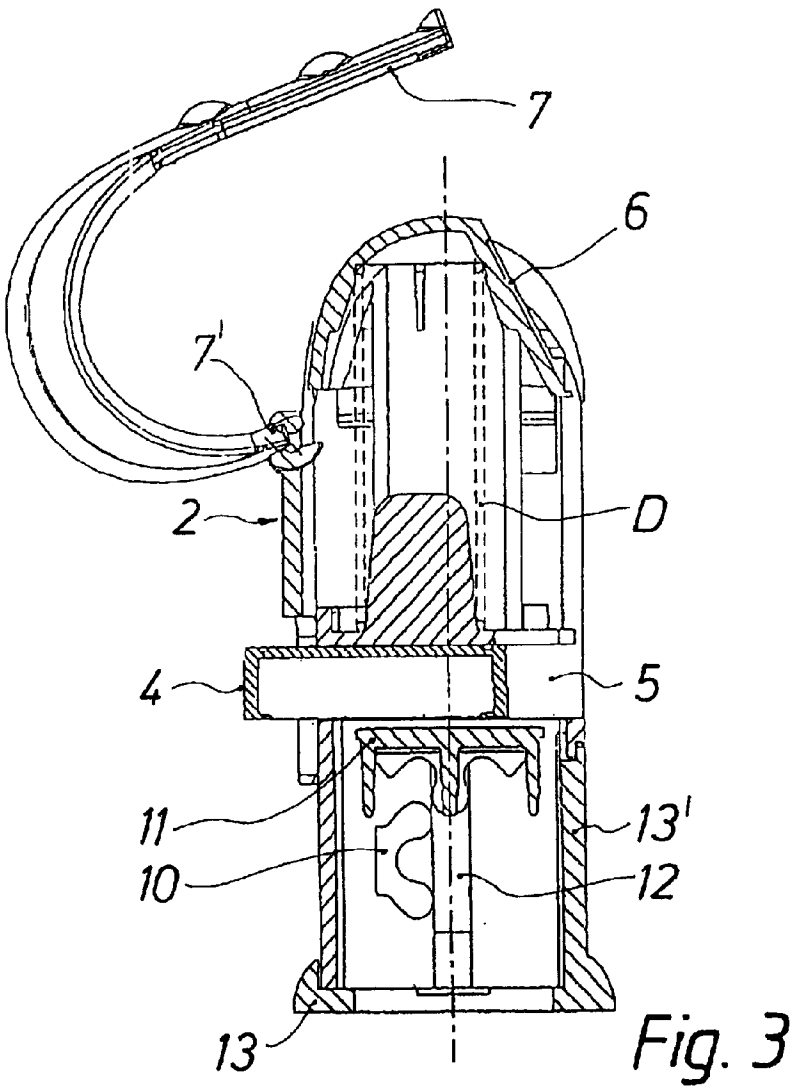
FIG. 3 is a sectional view of the stamp with the hood in its open state.
Figure 2:
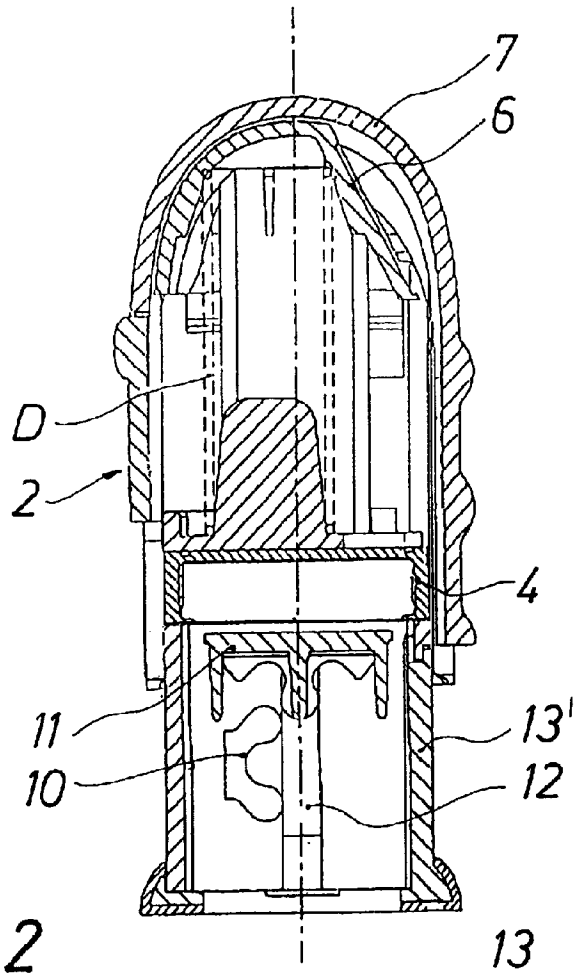
FIG. 2 is a sectional view of the closed stamp.
Figure 4:
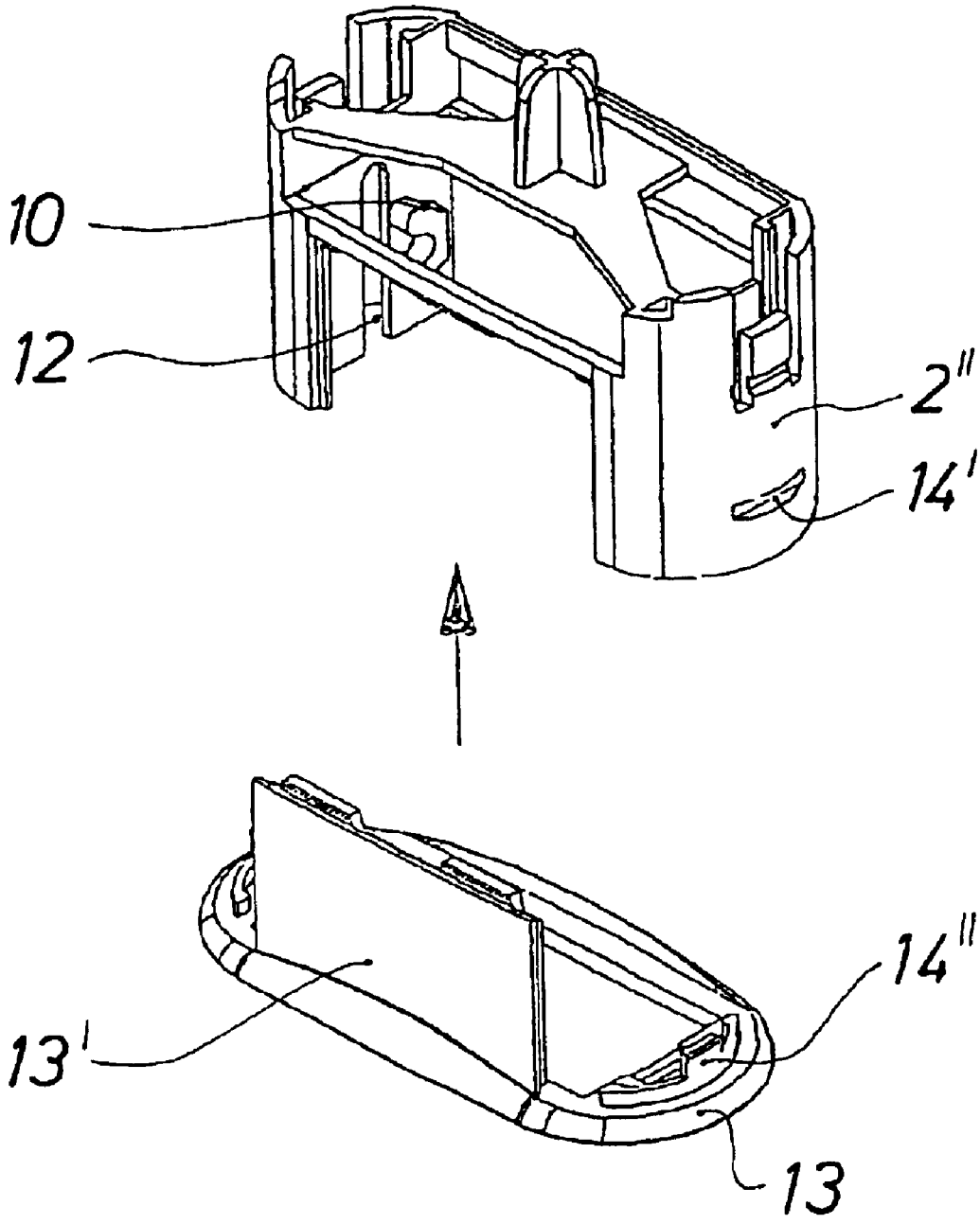
FIG. 4 is an exploded view depicting the insertion of the support frame.

The upper component 2 has a substantially U-shaped body portion 2' which at its upper transverse member supports an oblique text receiving surface 6, which allows visual access from above and from the front. At its top and front sections the upper component is covered by a pivotal hood part 7 which at 7' is pivotally mounted at the rear section of the upper component 2. By upwardly pivoting the hood part 7 the stamp pad shaft 5 of the lower component 1 is rendered accessible for exchanging the stamp pad 4 as shown in FIG. 3. The upper component 2 also receives an actuator pressure spring D (see FIGS. 2 and 3) extending upwardly from the stamp pad shaft 5. In its side walls the lower component 1 is provided with a conventional swivel mechanism 10 for the print platen support 11 which is inserted from below into slots 12 in the walls of the lower component 1 and which by its axle stubs 11' is snap-fitted to elastic lateral support tongues 2" of the upper component 2.

The bottom side of the lower component 1 is enclosed by a support frame 13 which is secured against slipping by hooks 14" resiliently snapped into lateral slots 14' of the lower component 1. The support frame also forms an upwardly extending transparent cover 13' for the open front section of the lower component 1. This structure of the lower component 1 simplifies the assembly of the stamp because the print platen support 11 may be inserted in a simple manner after which the support frame 13 may be mounted. The upper component 2 and the lower component 1 of the stamp may be maintained in a compressed state by lateral arresting members 3', 3".

The advantage of the construction in accordance with the invention is that the lower component 1 functions as an alignment member in view of the fact that its transparent front section provides visual access to the area to be stamped so that the stamp may be accurately positioned.

What is claimed is:

1. A self-inking stamp with overhead inking, with a lower component for placement on the surface to be stamped, with a swivel mechanism for a print platen support arranged in the lower component for swiveling reciprocal movement between a stamp pad and a support frame, and with an actuator upper component mounted for slideable movement against the bias of a spring relative to the lower component, the upper component straddling the lower component and connected by its lateral parts to the lower component by a print platen support swivel axle guided in elongated openings of the lower component, characterized by the fact that the actuator upper component (2) is provided with a substantially U-shaped body portion (2') and a hood part (7) of transparent material pivotally connected therewith and covering an oblique text receiving plate (6) at the upper transverse member of the body portion (2') and the open front section of the body portion, and that the lower component (1) in a direction away from the stamp pad receptacle (5) at its front section forms an opening in a downward direction, the opening being covered by a transparent wall member (13') extending upwardly from the support frame (13) which is connected with the lower component by a resilient snap connection (14', 14").

2. The self-inking stamp of claim 1, characterized by the fact that the pivoting hood part (7) is pivotally connected at the area of the rear section of the upper component (2) and extends from its connection to the front section of the upper component across the apex thereof.

* * * * *